US007450876B2

(12) United States Patent
Ishii et al.

(10) Patent No.: US 7,450,876 B2
(45) Date of Patent: Nov. 11, 2008

(54) DEVELOPING CARTRIDGE, IMAGE HOLDING BODY CARTRIDGE, PROCESS CARTRIDGE AND IMAGE FORMING APPARATUS THAT ARE CAPABLE OF APPLYING A BIAS VOLTAGE TO A DEVELOPING ROLLER WITHOUT INDICATION OF THE DEVELOPING ROLLER

(75) Inventors: Makoto Ishii, Nagoya (JP); Fumikazu Sato, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 60 days.

(21) Appl. No.: 11/070,168

(22) Filed: Mar. 3, 2005

(65) Prior Publication Data

US 2005/0201772 A1 Sep. 15, 2005

(30) Foreign Application Priority Data

Mar. 15, 2004 (JP) ..... 2004-073307

(51) Int. Cl.
*G03G 15/00* (2006.01)

(52) U.S. Cl. ..... 399/90; 399/111

(58) Field of Classification Search ..... 399/90, 399/111, 119

See application file for complete search history.

(56) References Cited

U.S. PATENT DOCUMENTS

| | | | | |
|---|---|---|---|---|
| 5,500,714 | A | 3/1996 | Yashiro et al. | |
| 5,543,898 | A | 8/1996 | Shishido et al. | |
| 5,617,579 | A | 4/1997 | Yashiro et al. | |
| 5,619,309 | A | 4/1997 | Yashiro et al. | |
| 5,652,647 | A | 7/1997 | Yashiro et al. | |
| 5,689,774 | A | 11/1997 | Shishido et al. | |
| 5,768,658 | A | 6/1998 | Watanabe et al. | |
| 5,878,309 | A * | 3/1999 | Nomura et al. | 399/111 |
| 6,064,842 | A | 5/2000 | Takeuchi et al. | |
| 6,185,390 | B1 * | 2/2001 | Higeta et al. | 399/90 |
| 6,308,028 | B1 | 10/2001 | Yashiro et al. | |
| 6,366,746 | B1 | 4/2002 | Sasago et al. | |
| 6,408,142 | B1 | 6/2002 | Takeuchi et al. | |
| 6,823,160 | B2 | 11/2004 | Okabe | |
| 2002/0025174 | A1 * | 2/2002 | Sakurai et al. | 399/13 |
| 2002/0191981 | A1 * | 12/2002 | Miyabe et al. | 399/90 |
| 2003/0156848 | A1 * | 8/2003 | Kawai et al. | 399/27 |
| 2003/0223775 | A1 * | 12/2003 | Yoshino et al. | 399/119 |

FOREIGN PATENT DOCUMENTS

| | | |
|---|---|---|
| JP | A 08-314358 | 11/1996 |
| JP | A-09-015967 | 1/1997 |
| JP | A 09-034336 | 2/1997 |

(Continued)

*Primary Examiner*—Quana M Grainger
(74) *Attorney, Agent, or Firm*—Oliff & Berridge, PLC

(57) ABSTRACT

A developing cartridge includes a developing roller, wherein a bias voltage is capable of being applied to the developing roller; and a developer-side electrode portion that is electrically connected with a shaft member of the developing roller, wherein the developer-side electrode portion is positioned at the bottom of the developing roller in order to apply the bias voltage to the developing roller, and the developing cartridge is capable of being mounted to an image holding body cartridge with an image holding body that holds a developing agent image formed by a development of an electrostatic latent image.

22 Claims, 5 Drawing Sheets

FOREIGN PATENT DOCUMENTS

| | | |
|---|---|---|
| JP | A 11-161131 | 6/1999 |
| JP | A-2001-215765 | 8/2001 |
| JP | A 2001-215783 | 8/2001 |
| JP | A 2001-242755 | 9/2001 |
| JP | A-2002-099145 | 4/2002 |
| JP | A 2003-216005 | 7/2003 |
| JP | A 2003-295614 | 10/2003 |

* cited by examiner

DEVELOPING CARTRIDGE, IMAGE HOLDING BODY CARTRIDGE, PROCESS CARTRIDGE AND IMAGE FORMING APPARATUS THAT ARE CAPABLE OF APPLYING A BIAS VOLTAGE TO A DEVELOPING ROLLER WITHOUT INDICATION OF THE DEVELOPING ROLLER

INCORPORATION BY REFERENCE

This application claims priority from Japanese Patent Application No. 2004-073307, filed Mar. 15, 2004, the subject matter of which is incorporated herein in its entirety by reference thereto.

BACKGROUND

The disclosure relates to a developing cartridge, an image holding body cartridge, a process cartridge, and an image forming apparatus.

In an image forming apparatus to which a developing cartridge having a rotatable developing roller is attached, a bias voltage is applied to the developing roller from a power supply electrode connected with an electric circuit provided to a body of the image forming apparatus. The bias voltage is applied in a state where the developing cartridge is attached to the image forming apparatus. U.S. Pat. No. 6,823,160 discloses such a structure (FIG. 8A in the patent). In this structure, an electrical supply member is integrally provided to an extended portion of a roller shaft of the developing roller in an axial direction of the roller shaft. An electrode plate, as the power supply electrode, is arranged so as to press an end surface of the electrical supply member in the axial direction. With this structure, the electrical supply member and the electrode plate are electrically connected with each other so that a bias voltage is applied to the developing roller.

The developing roller develops an image by adhering a developing agent to a latent image which is formed on the surface of a photosensitive drum. In order to increase development accuracy, the developing roller needs to contact the photosensitive drum with a uniform pressure along a length of the photosensitive drum in an axial direction of the photosensitive drum.

SUMMARY

However, in the structure disclosed in U.S. Pat. No. 6,823,160, the electrode plate provided on the image forming apparatus body exerts a pressing force on the developing roller. The developing roller may therefore be inclined with respect to the photosensitive drum because of a resultant force of the pressing force from the electrode plate and a pressure contact force from the photosensitive drum. Nonuniform contact thus occurs between the developing roller and the photosensitive drum and development accuracy may be degraded.

The disclosure thus provides, among other things, a developing cartridge, an image holding body cartridge, a process cartridge and an image forming apparatus, which are capable of applying a bias voltage to a developing roller without degrading the development accuracy.

According to one exemplary aspect of the disclosure, a developing cartridge includes a developing roller, wherein a bias voltage is capable of being applied to the developing roller; and a developer-side electrode portion that is electrically connected with a shaft member of the developing roller, wherein the developer-side electrode portion is positioned at the bottom of the developing roller in order to apply the bias voltage to the developing roller, and the developing cartridge is capable of being mounted to an image holding body cartridge with an image holding body that holds a developing agent image formed by a development of an electrostatic latent image.

According to one exemplary aspect of the disclosure, an image holding body cartridge includes an image holding body that holds a developing agent image formed by development of an electrostatic latent image; and a cartridge frame with an opening at a bottom of the cartridge frame, wherein when a developing cartridge with a developing roller and a developer-side electrode portion is mounted on the cartridge frame and the image holding body cartridge is mounted on a image forming apparatus with a power supply electrode, the power supply electrode portion contacts the developer-side electrode portion via the opening in order to apply a bias voltage from the power supply electrode to the developing roller.

According to one exemplary aspect of the disclosure, an image holding body cartridge includes an image holding body that holds a developing agent image formed by development of an electrostatic latent image; a cartridge frame, a portion of which is capable of being interposed between a power supply electrode provided to a body of an image forming apparatus and a developer-side electrode portion which opposingly contacts the power supply electrode from above to apply a bias voltage from the power supply electrode to a developing roller; and a conductive member that can bring an upper surface and a lower surface of the portion of the cartridge frame interposed between the developer-side electrode portion and the power supply electrode into conduction, wherein the developer-side electrode portion and the power supply electrode are capable of being electrically connected with each other via the conductive member.

BRIEF DESCRIPTION OF THE DRAWINGS

Exemplary embodiments of the disclosure will be described in detail with reference to the following figures wherein.

DETAILED DESCRIPTION OF EMBODIMENTS

Exemplary embodiments of the disclosure will be described with reference to the accompanying drawings. First, referring to FIGS. 1 to 4, descriptions will be given using a laser beam printer as an example of an image forming apparatus according to a first exemplary embodiment of the disclosure.

Figure 1:
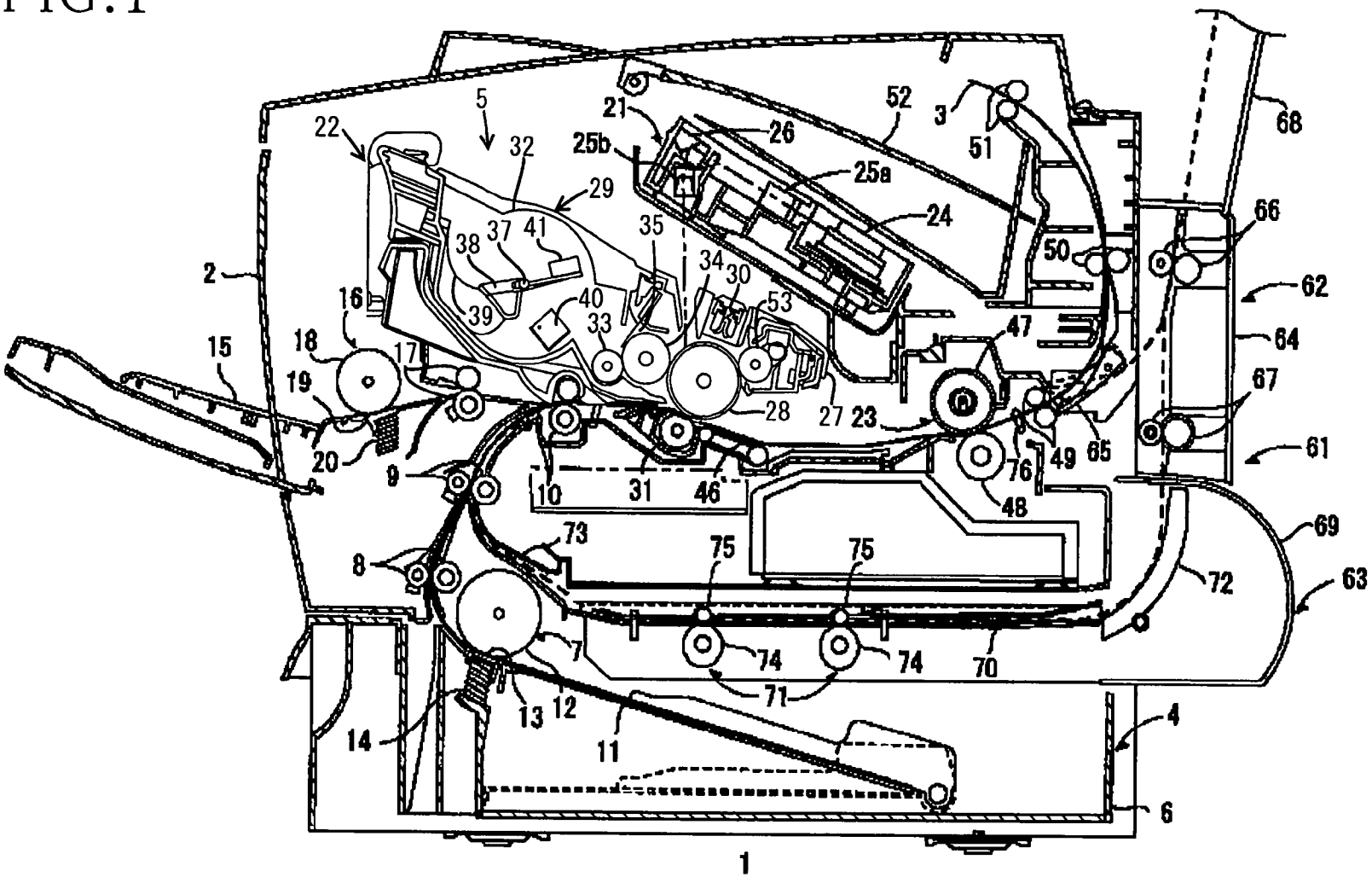
FIG. 1 is a side sectional view showing essential parts of a laser beam printer according to an exemplary embodiment of the disclosure.

In a laser beam printer 1 using an electrophotographic method shown in FIG. 1, images are formed by a developing method using a positively charged non-magnetic single-component polymerized toner. A feeder portion 4 for supplying a sheet 3 and an image forming portion 5 for forming an image on the supplied sheet 3 are arranged in a body casing 2 of the laser beam printer 1. In FIG. 1, the orientation of the laser beam printer 1 is defined such that the right side of the drawing is referred to as the rear of the laser beam printer 1, the left side of the drawing is referred to as the front of the laser beam printer 1, the upper side of the drawing is referred to as the upper side of the laser beam printer 1, and the lower side of the drawing is referred to as the lower side of the laser beam printer 1.

The feeder portion 4 includes a sheet supply tray 6, a sheet supply mechanism 7, pairs of conveyor rollers 8, 9 and a pair of resist rollers 10. The sheet supply tray 6 is arranged so as to be attachable to and detachable from a bottom portion of the body casing 2. The sheet supply mechanism 7 is arranged at one end of the sheet supply tray 6. The conveyor rollers 8, 9 are arranged downstream of the sheet supply mechanism 7 in a sheet conveying direction. The pair of resist rollers 10 is arranged downstream of the conveyor rollers 8, 9 in the sheet conveying direction.

The sheet supply tray 6 has a box shape with an upper side open for stacking sheets 3 therein, and is attachable to and detachable from the bottom portion of the body casing 2 in a horizontal direction. A sheet pressing plate 11 is provided in the sheet supply tray 6. The sheets 3 are stacked on the sheet pressing plate 11. The sheet pressing plate 11 is supported by its end portion that is farther from the sheet supply mechanism 7 so as to swing and the end portion of the pressing plate 11 that is closer to the sheet supply mechanism 7 moves up and down. The sheet pressing plate 11 is upwardly urged from its underside by a spring (not shown). The sheet pressing plate 11 downwardly swings about the end portion that is farther from the sheet supply mechanism 7 against an urging force of the spring as the amount of the sheets 3 is increased.

The sheet supply mechanism 7 includes a sheet supply roller 12, a separation pad 13 that faces the sheet supply roller 12, and a spring 14 that is arranged at an underside of the separation pad 13. The separation pad 13 is pressed toward the sheet supply roller 12 by urging force of the spring 14. A topmost sheet 3 in the stack on the sheet pressing plate 11 is pressed toward the sheet supply roller 12 by the spring from the underside of the sheet pressing plate 11. A topmost sheet 3 in the stack placed on the sheet pressing plate 11 is pinched by the sheet supply roller 12 and the separation pad 13 by the rotation of the sheet supply roller 12, and then is separated and supplied from the stack, one by one, by their cooperation. The supplied sheet 3 is conveyed to the resist rollers 10 by the conveyor rollers 8, 9. The pair of resist rollers 10 corrects diagonal feeding of the sheet 3 and conveys the sheet 3 to an image forming position (referred to as an image transfer position where a toner image is transferred onto the supplied sheet 3 and also referred to as a contact portion of a photosensitive drum 28 and a transfer roller 31).

The feeder portion 4 of the laser beam printer 1 includes a multipurpose tray 15 for stacking sheets 3 of any size, a multipurpose-side sheet supply mechanism 16 for supplying the sheets 3 stacked on the multipurpose tray 15, and a pair of multipurpose-side conveyor rollers 17. Sheets 3 of any size can be stacked on the multipurpose tray 15. The multipurpose-side sheet supply mechanism 16 includes a multipurpose-side sheet supply roller 18, a multipurpose-side separation pad 19 that faces the multipurpose-side sheet supply roller 18 and a spring 20 that is provided at an underside of the multipurpose-side separation pad 19. The multipurpose-side separation pad 19 is pressed toward the multipurpose-side sheet supply roller 18 by an urging force of the spring 20.

A topmost sheet 3 in the stack placed on the multipurpose tray 15 is pinched by the multipurpose-side sheet supply roller 18 and the multipurpose-side sheet supply pad 19 by rotation of the multipurpose-side sheet supply roller 18 and is separated and supplied from the stack, one by one, by their cooperation. The supplied sheet 3 is then conveyed to the resist rollers 10 by the multipurpose-side conveyor roller 17.

The image forming portion 5 includes a scanning portion 21, a process unit 22, and a fixing portion 23.

The scanning portion 21 is arranged at an upper portion in the body casing 2 and includes a laser emitting portion (not shown), a rotatable polygon mirror 24, lenses 25*a*, 25*b* and a reflector 26. In the scanning portion 21, a laser beam that is emitted from the laser emitting portion based on image data passes through or is reflected off the polygon mirror 24, the lens 25*a*, the reflector 26 and the lens 25*b* in this order as shown by a dot-dashed line and the laser beam is irradiated to a surface of the photosensitive drum 28 of the process unit 22 by a speed scanning.

Figure 2:
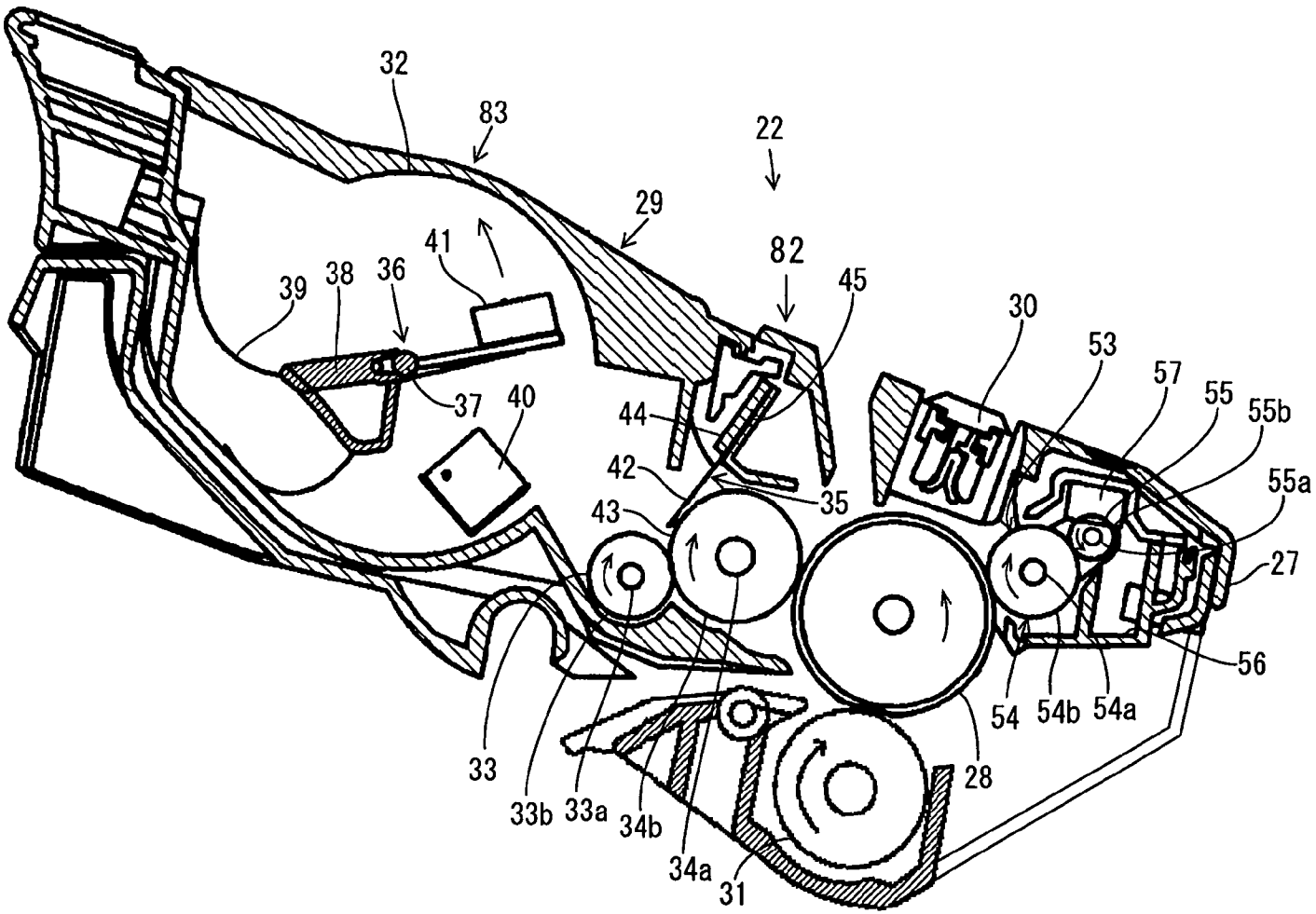
FIG. 2 is a side sectional view of a process unit.

The process unit 22 is provided below the scanning portion 21. The process unit 22, as a process cartridge, is detachably attached to the body casing 2. As shown in FIG. 2, the process unit 22 includes the photosensitive drum 28, a developing cartridge 29 as a developing device, a scorotron charging device 30, a transfer roller 31, and a cleaning unit 53, in a drum frame 27 of the process unit 22. In the process unit 22, a structure not including the developing cartridge 29 serves as a photosensitive body cartridge 95 functioning as an image holding body cartridge. The orientation of the process unit 22 is defined such that the left side of the drawing is referred to as the front of the process unit 22 and the right side of the drawing is referred to as the rear of the process unit 22 in FIG. 2. The defined orientation is adopted throughout all the drawings.

Figure 3:
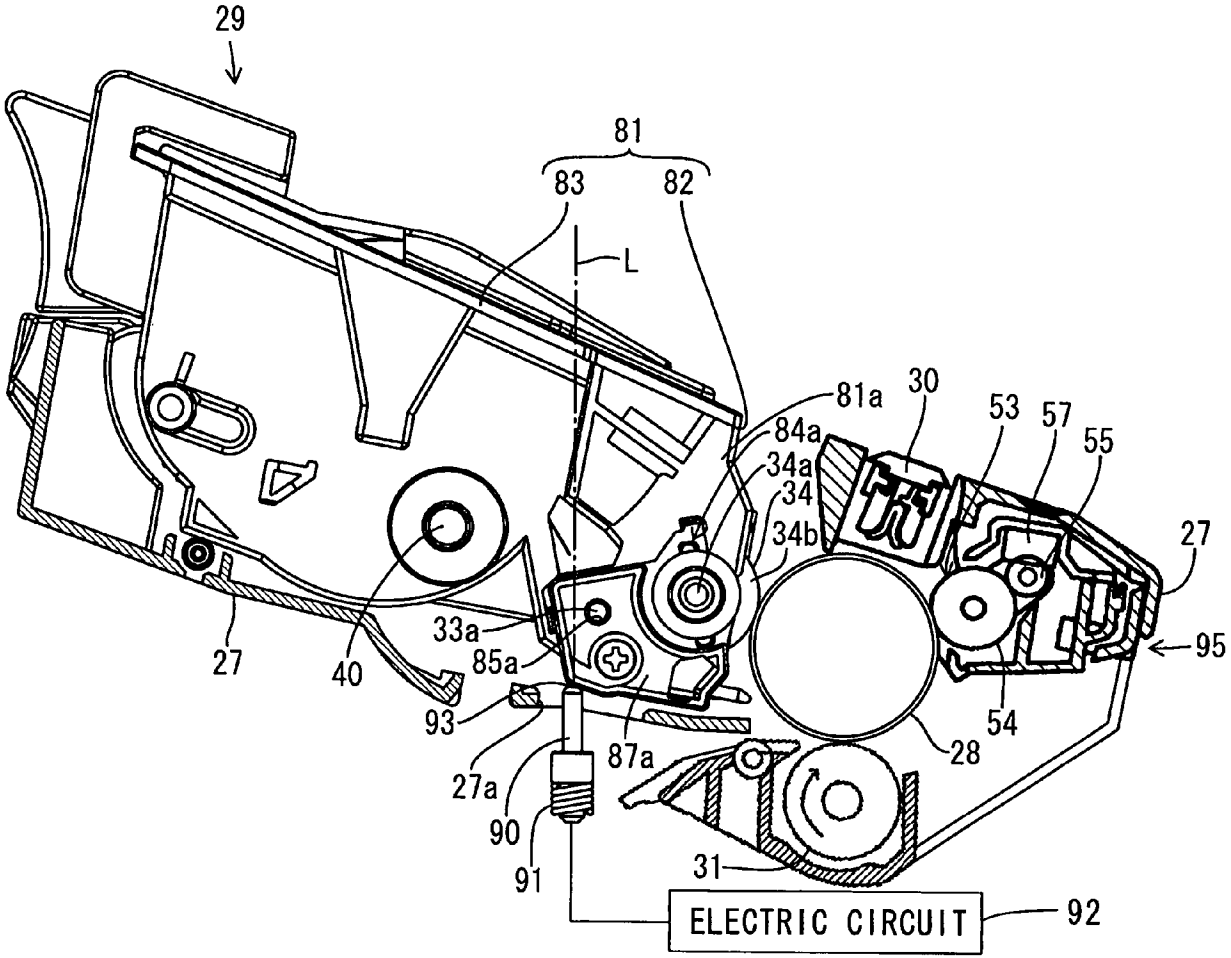
FIG. 3 is a side view of a developing cartridge.

The developing cartridge 29 can be attached to and detached from the drum frame 27. The developing cartridge 29 includes a toner hopper 32 as a storage chamber, a toner supply roller 33 as a developing agent supply member disposed at a side of the toner hopper 32, a developing roller 34 as a developing agent holding member, and a layer thickness regulating blade 35, as shown in FIGS. 2 and 3.

The toner hopper 32 stores positively charged non-magnetic single-component toner, as developing agent. The toner is a polymerized toner obtained through co-polymerization of styrene-based monomers, such as styrene, and acryl-based monomers, such as acrylic acid, alkyl(C1-C4)acrylate, alkyl (C1-C4)methacrylate, using a known polymerization method, such as suspension polymerization. The polymerized toner has a substantially spherical shape and has excellent fluidity. A coloring agent, such as carbon black, and wax are added to the polymerized toner. An external additive, such as silica, is also added to the polymerized toner to improve its fluidity. The particle size of the polymerized toner is approximately 6-10 μm. Thus, a high quality image can be formed.

An agitator 36 is provided in the toner hopper 32. The agitator 36 includes a rotating shaft 37, an agitating blade 38 and a film 39. The rotating shaft 37 is rotatably supported at a center of the toner hopper 32. The agitating blade 38 is fixed to the rotating shaft 37 and extends therefrom. The film 39 is stuck to a free end of the agitating blade 38. When the rotating shaft 37 is rotated in a direction indicated by an arrow in FIG. 2 (in a counterclockwise direction), the agitating blade 38 moves around the rotating shaft 37 and the film 39 scoops up the toner in the toner hopper 32 to supply the toner to the toner supply roller 33. A cleaner 41 is fixed to the rotating shaft 37 of the agitator 36 in order to clean a toner amount detecting window 40 provided on a side wall of the toner hopper 32. The cleaner 41 is disposed on a side opposite the agitating blade 38 with respect to the rotating shaft 37.

The toner supply roller 33 is provided at a side of the toner hopper 32 so as to be rotatable in a direction indicated by an arrow in FIG. 2 (in a clockwise direction). The toner supply roller 33 includes a metal roller shaft 33*a* covered with a roller portion 33*b* made of a conductive urethane foam.

The developing roller 34 is provided at a side of the toner supply roller 33 so as to be rotatable in a direction indicated by an arrow in FIG. 2 (in the clockwise direction). The developing roller 34 includes a metal roller shaft 34*a* covered with a roller portion 34*b* made of a conductive elastic material. More specifically, the roller portion 34*b* of the developing roller 34 is made of conductive urethane rubber or conductive silicone rubber containing carbon particles and its surface is covered with a coating layer made of urethane rubber or silicone rubber containing fluorine. A predetermined developing bias is applied to the roller shaft 34*a* of the developing roller 34.

The toner supply roller 33 and the developing roller 34 are opposingly in contact with each other so that they are press-deformed against each other to an appropriate extent. The toner supply roller 33 and the developing roller 34 are designed so as to rotate in opposite directions at a contact portion of the toner supply roller 33 and the developing roller 34.

The layer thickness restricting blade 35 is disposed above the toner supply roller 33 and extends along an axial direction of the developing roller 34. The layer thickness restricting blade 35 is opposite to the developing roller 34 with respect to the rotating direction of the developing roller 34, between a position where the developing roller 34 faces the toner supply roller 33 and a position where the developing roller 34 faces the photosensitive drum 28. The layer thickness regulating blade 35 includes a leaf spring member 42, a press-contact portion 43, a backup member 44, and a support member 45. The press-contact portion 43 made of an insulative silicone rubber is provided at a free end of the leaf spring member 42 and contacts the developing roller 34. The backup member 44 is provided at a rear side of the plate spring member 42. The support member 45 is provided to support a rear end portion of the leaf spring member 42 by the developing cartridge 29. In the layer thickness regulating blade 35, the press-contact portion 43 is pressed on the surface of the developing roller 34 by an elastic force of the leaf spring member 42.

With this structure, the toner stored in the toner hopper 32 is scooped up by the rotation of the agitator 36 and then supplied to the toner supply roller 33. By the rotation of the agitator 36, the cleaner 41 is rotated to wipe clean the toner amount detecting window 40. The toner supplied to the toner supply roller 33 is then supplied to the developing roller 34 by the rotation of the toner supply roller 33. At that time, the toner is positively charged by friction caused between the toner supply roller 33 and the developing roller 34. The toner supplied onto the developing roller 34 is further supplied between the press-contact portion 43 of the layer thickness regulating blade 35 and the developing roller 34 by the rotation of the developing roller 34, so that the toner becomes a thin layer having a uniform thickness and is held on the developing roller 34.

The photosensitive body cartridge 95 includes the photosensitive drum 28 as an image holding body, the scorotron charging device 30, the transfer roller 31, and a cleaning unit 53, in the drum frame 27.

The drum frame 27 accommodates the developing cartridge 29 so as to cover the lower side of the developing cartridge 29. The photosensitive drum 28 is disposed at a side of the developing roller 34 so as to be opposite to the developing roller 34. The photosensitive drum 28 is supported by the drum frame 27 so as to be rotatable in a direction indicated by an arrow in FIG. 2 (in the counterclockwise direction). A drum body of the photosensitive drum 28 is connected to the ground. A top layer of the photosensitive drum 28 is a positively-charged photosensitive layer made of, for example, polycarbonate.

The scorotron charging device 30 is supported by the drum frame 27 and is located above the photosensitive drum 28 so as to be opposite to the photosensitive drum 28 at the predetermined distance from each other. The scorotron charging device 30 is an electrifier that generates corona discharge from charging wires, such as tungsten wires, in order to uniformly positively charge the surface of the photosensitive drum 28.

The cleaning unit 53 is disposed at an opposite side of the developing roller 34 with respect to the photosensitive drum 28 in the drum frame 27. The cleaning unit 53 includes a first cleaning roller 54, a second cleaning roller 55, a paper dust storage portion 56 and a scraper 57.

The first cleaning roller 54 is disposed downstream of a position where the photosensitive drum 28 faces the transfer roller 31 and upstream of a position where the photosensitive drum 28 faces the scorotron charging device 30 in the rotating direction of the photosensitive drum 28 while being in contact with the photosensitive drum 28. The first cleaning roller 54 includes a metal roller shaft 54*a* and a roller portion 54*b* made of a conductive foam material, for example, silicone rubber foam, urethane rubber foam, and EPDM foam. The first cleaning roller 54 is connected to the photosensitive drum 28 via gears (not shown) and is supported by the drum frame 27 so as to be rotatable in a direction indicated by an arrow in FIG. 2 (in the clockwise direction) in accordance with the rotation of the photosensitive drum 28.

The second cleaning roller 55 is opposingly provided so as to be in contact with the first cleaning roller 54, at the opposite side to the photosensitive drum 28 with respect to the first cleaning roller 54. The second cleaning roller 55 includes a metal roller shaft 55*a* and a metal roller portion 55*b*, which are integrated with each other. The second cleaning roller 55 is connected with the first cleaning roller 54 via gears (not shown) and is supported by the drum frame 27 so as to be rotatable in a direction indicated by an arrow in FIG. 2 (in the counterclockwise direction) in accordance with the rotation of the first cleaning roller 54.

The paper dust storage portion 56 is a space defined by the drum frame 27 at a position opposite to the first cleaning roller 54 with respect to the second cleaning roller 55. The scraper 57 is provided above the second cleaning roller 55 while being supported by the drum frame 27 so as to be in contact with the second cleaning roller 55. The scraper 57 is made of foam material such as urethane and wipes off paper dust adhering to the second cleaning roller 55.

With this structure, first, the surface of the photosensitive drum 28 is uniformly positively charged by the scorotron charging device 30 in accordance with the rotation of the photosensitive drum 28. Then, the surface of the photosensitive drum 28 is exposed to a laser beam emitted from the scanning portion 21 and an electrostatic latent image based on image data is formed onto the surface of the photosensitive drum 28. After that, when the electrostatic latent image on the photosensitive drum 28 faces and contacts the developing roller 34, the positively charged toner held on the developing roller 34 is supplied onto and held by the electrostatic latent image formed on the photosensitive drum 28, i.e., a portion whose potential is lowered by the exposure by the laser beam. Thus, the toner is selectively held by the photosensitive drum 28 and the image is visualized thereon. Accordingly, a reversal phenomenon is achieved.

The transfer roller 31 is opposingly disposed below the photosensitive drum 28 and is supported by the drum frame 27 so as to be rotatable in a direction indicated by an arrow in FIG. 2 (in the clockwise direction). The transfer roller 31 includes a metal roller shaft covered with a roller portion made of a conductive rubber material. At the time of transfer, a predetermined transfer bias is applied to the photosensitive drum 28.

After that, when the visualized image held by the surface of the photosensitive drum 28 contacts the sheet 3 conveyed by the resist rollers 10 of the feeder portion 4 by the rotation of the photosensitive drum 28 after the diagonal feeding of the sheet 3 is corrected, the visualized image is transferred onto the sheet 3 while the sheet 3 passes between the photosensitive drum 28 and the transfer roller 31. The sheet 3 onto which the visualized image is transferred is further conveyed to the fixing portion 23 via a conveyor belt 46, as shown in FIG. 1.

The fixing portion 23 is provided at a side of the process unit 22 and downstream of the process unit 22 in the sheet conveying direction. The fixing portion 23 includes a heat roller 47, a pressing roller 48 and a pair of conveyor rollers 49. The heat roller 47 includes a metal base tube and a halogen lamp in the base tube to generate heat. The pressing roller 48 is opposingly disposed below the heat roller 47 so as to press the heat roller 47 from below. The pair of conveyor rollers 49 is disposed downstream of the heat roller 47 and the pressing roller 48 in the sheet conveying direction.

The visualized image formed on the sheet 3 is thermally fixed thereon while the sheet 3 conveyed to the fixing portion 23 passes between the heat roller 47 and the pressing roller 48. Then, the sheet 3 is conveyed by the conveyor rollers 49 to a pair of conveyor rollers 50 and a pair of sheet discharge rollers 51 that are provided in the body casing 2. The conveyor rollers 50 are disposed downstream of the conveyor rollers 49 in the sheet conveying direction. The sheet discharge rollers 51 are disposed above a sheet discharge tray 52. The sheet 3 conveyed by the conveyor rollers 49 is conveyed to the sheet discharge rollers 51 by the conveyor rollers 50 and then discharged onto the sheet discharge tray 52 by the sheet discharge rollers 51.

The laser beam printer 1 includes a reconveyance unit 61 to form images on both sides of a sheet 3. The reconveyance unit 61 includes a reverse mechanism 62 and a reconveyance tray 63 that are integrated with each other. The reverse mechanism 62 is externally mounted from a rear side of the body casing 2 and the reconveyance tray 63 is inserted above the feeder portion 4. The reconveyance unit 61 is detachably attached to the body casing 2.

The reverse mechanism 62 is externally attached to the rear wall of the body casing 2. The reverse mechanism 62 includes a casing 64 having a substantially rectangular shape in cross section, a pair of reverse rollers 66, a pair of reconveyance rollers 67, and a reverse guide plate 68. The reverse guide plate 68 extends upwardly and protrudes from an upper end of the body casing 2.

A flapper 65 is arranged downstream of the conveyor rollers 49 in order to selectively change the sheet conveying direction between a direction toward the conveyor rollers 50 (a solid line shown in FIG. 1) and a direction toward the reverse rollers 66 (a dotted line shown in FIG. 1). The flapper 65 is swingably supported at the rear portion of the body casing 2 and disposed downstream and in the vicinity of the conveyor rollers 49. The flapper 65 can swing so as to selectively change the direction of conveying a sheet 3, which has an image on one side and is conveyed by the conveyor rollers 49, between the direction toward the conveyor rollers 50 (the solid line shown in FIG. 1) and the direction toward the reverse rollers 66 (the dotted line shown in FIG. 1), in accordance with excitation or non-excitation of a solenoid (not shown).

The pair of reverse rollers 66 is arranged downstream of the flapper 65 and at an upper side of the casing 64. The rotating direction of the reverse rollers 66 can be switched between a normal direction and a reverse direction. The reverse rollers 66 first rotate in the normal direction to convey a sheet 3 to the reverse guide plate 68 and then rotate in the reverse direction to convey the sheet 3 in the reverse direction to the reconveyance rollers 67.

The pair of reconveyance rollers 67 is arranged under and downstream of the pair of reverse rollers 66. The reconveyance rollers 67 convey the sheet 3, which was turned upside down by the reverse rollers 66, to the reconveyance tray 63. The reverse guide plate 68 is a plate-like member that extends upward and protrudes from the upper end of the casing 64. The reverse guide plate 68 guides the sheet 3 that is conveyed by the reverse rollers 66.

To form images on both sides of a sheet 3, first, the flapper 65 is switched to the position that allows the sheet 3 to be conveyed to the reverse rollers 66, so that the sheet 3 having an image on one side is passed to the reverse mechanism 62. After that, when the sheet 3 reaches the reverse rollers 66, the reverse rollers 66 rotate in the normal direction while pinching the sheet 3 therebetween, to convey the sheet 3 upward so that a majority of the sheet 3 is discharged to the outside of the laser beam printer 1. When pinching the trailing edge of the sheet 3, the reverse rollers 66 stop rotating in the normal direction. Then, the reverse rollers 66 rotate in the reverse direction to convey the sheet 3 downward to the reconveyance rollers 67 while the orientation of the sheet 3 is reversed (the trailing edge of the sheet 3 is situated at the front in a sheet traveling direction). A sheet passage sensor 76 is provided downstream of the fixing portion 23. When a predetermined time has elapsed after the sheet passage sensor 76 detects the trailing edge of the sheet 3, the rotating direction of the reverse rollers 66 is changed to the reverse direction from the normal direction. When the conveyance of the sheet 3 to the reverse rollers 66 is completed, the flapper 65 is switched to the position that allows the sheet 3 to be conveyed to the conveyor rollers 50.

Then, the reversed sheet 3 conveyed to the reconveyance rollers 67 is further conveyed to the reconveyance tray 63 by the reconveyance rollers 67. The reconveyance tray 63 includes a sheet supply portion 69 where a sheet 3 is supplied, a tray body 70, and pairs of skew rollers 71. The sheet supply portion 69 is externally attached to a lower side of the reverse mechanism 62 in the rear of the body casing 2, and includes a curved sheet guiding member 72. In the sheet supply portion 69, the sheet 3 substantially vertically conveyed from the reconveyance rollers 67 of the reverse mechanism 62 is guided so as to be conveyed substantially in a horizontal direction by the sheet guiding member 72 to be conveyed to the tray body 70.

The tray body 70 having a substantially rectangular shape is disposed in a substantially horizontal position above the sheet supply tray 6. An upstream end of the tray body 70 is connected with the sheet guiding member 72 and its downstream end is connected with an upstream end of the reconveyance path 73 that is connected with a midpoint of the sheet conveying path. At a midpoint in the sheet conveying direction of the tray body 70, the two pairs of skew rollers 71 are disposed at predetermined distance from each other in the sheet conveying direction to convey the sheet 3 while contacting the sheet 3 with a reference plate (not shown).

Each pair of the skew rollers 71 includes a drive skew roller 74 and a following skew roller 75. The drive skew roller 74 is disposed in the vicinity of the reference plate that is disposed on one end of the tray body 70 in its width direction. The drive skew roller 74 is arranged such that its axis direction is substantially perpendicular to the sheet conveying direction. The following skew roller 75 is disposed so as to be opposite to the drive skew roller 74 while sandwiching a sheet 3 therebetween. The following skew roller 75 is arranged such that its axis direction is diagonal with respect to the direction substantially perpendicular to the sheet conveying direction so that the sheet traveling direction extends toward the reference plate.

The upside-down sheet 3 that is conveyed from the sheet supply portion 69 to the tray body 70 is conveyed to the image forming position again via the reconveyance path 73 while one end of the sheet 3 in its width direction is contacted to the reference plate by the skew rollers 71. The sheet 3 that is conveyed to the image forming position opposingly contacts the photosensitive drum 28 with its side that is opposite to the side where the image has already formed, and a visualized image is transferred onto the sheet 3. After that, the image is fixed at the fixing portion 23 and the sheet 3 having images on both sides is discharged to the sheet discharge tray 52.

Next, a structure for supplying power to the developing roller 34 will be described with reference to FIGS. 3 and 4. FIG. 3 partially illustrates a section of the drum frame 27 that covers the lower side of the developing cartridge 29 of the photosensitive body cartridge 95.

Figure 4:
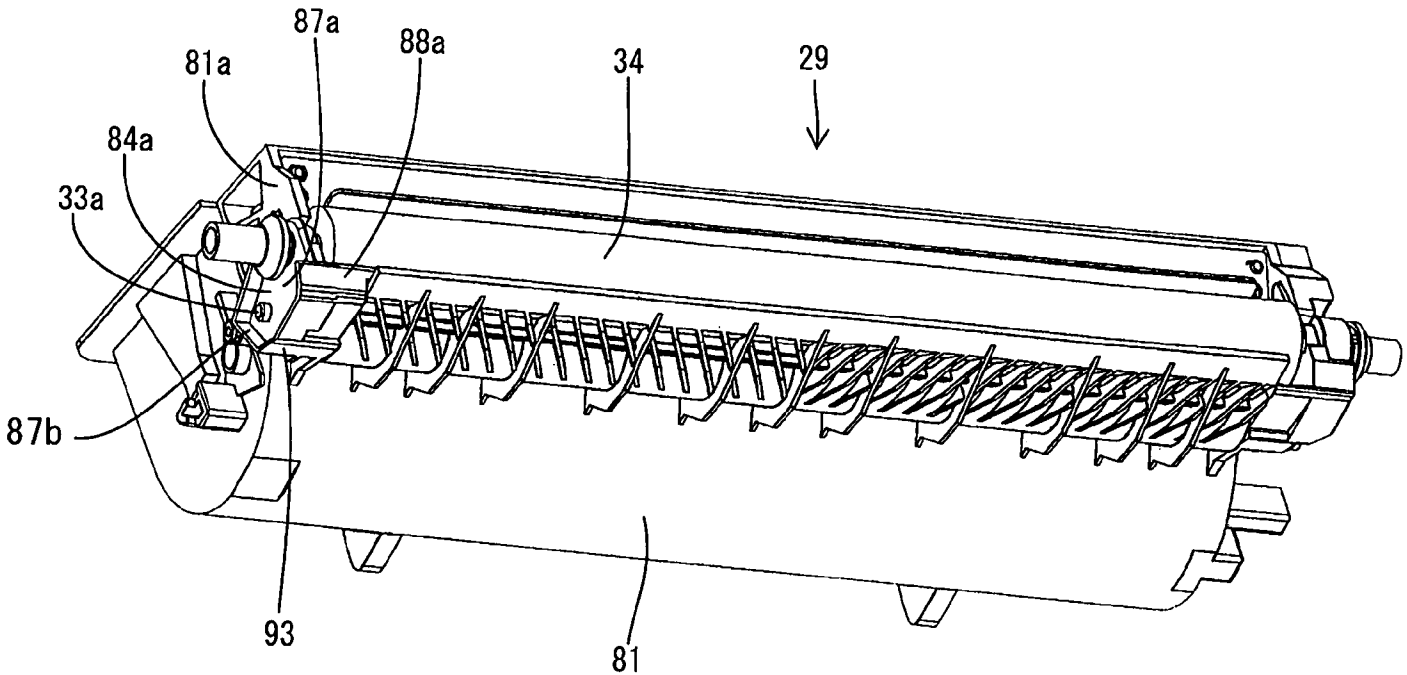
FIG. 4 is a perspective view of the developing cartridge when viewed from below.

As shown in FIG. 4, the developing cartridge 29 has a substantially rectangular shape, and includes a resin box-shaped housing 81 with its front end open. As shown in FIG. 3, the housing 81 includes a rearward portion 82 and a forward portion 83, which are integrated with each other. The rearward portion 82 includes the toner supply roller 33, the developing roller 34 and the layer thickness regulating blade 35. The forward portion 83 includes the toner hopper 32 and the agitator 36. As shown in FIGS. 3 and 4, the housing 81 has a shaft receiving member 87*a* at a side wall 81*a* of the rearward portion 82. Although the housing 81 has a side wall opposite to the side wall 81*a* in the rearward portion 82, description will be given as to the side wall 81*a* provided on a near side in FIG. 3 because only one of the side walls is related to the structure for supplying power to the developing roller 34.

The shaft receiving member 87*a* is a conductive resin member having a substantially rectangular flat-plate shape, and includes a developing roller bearing 84*a* and a toner supply roller insertion portion 85*a*. A shaft receiving member opposite to the shaft receiving member 87*a* is made of a common resin member with no conductivity.

The developing roller bearing 84*a* is an opening provided at a rear end portion of the shaft receiving member 87*a*. Likewise, a developing roller bearing having the same structure as the developing roller bearing 84*a* is provided at a rear end portion of the shaft receiving member so as to be opposite to the developing roller bearing 84*a*. The roller shaft 34*a* of the developing roller 34 is rotatably supported by the developing roller bearing 84*a* and the opposite developing roller bearing. That is, one end of the roller shaft 34*a* portion is rotatably supported by the developing roller bearing 84*a* of the shaft receiving member 87*a* so as to protrude to the outside of the housing 81 (the outside in the axial direction of the developing roller 34). Likewise, the other end portion of the roller shaft 34*a* of the developing roller 34 is rotatably supported by the opposite developing roller bearing of the shaft receiving member so as to protrude to the outside of the housing 81.

As shown in FIG. 4, the developing roller 34 is bared along its axial direction at the rear end of the housing 81 while being supported as described above. In this embodiment, conductive grease is applied between the roller shaft 34*a* of the developing roller 34 and the developing roller bearing 84*a*, so that the roller shaft 34*a* and the developing roller bearing 84*a* are electrically connected with each other and have an excellent slideability therebetween.

As shown in FIG. 3, the toner supply roller insertion portion 85*a* is an opening provided to the shaft receiving member 87*a*. Likewise, a toner supply roller insertion portion having the same structure as the toner supply roller insertion portion 85*a* is provided to the shaft receiving member so as to be opposite to the toner supply roller insertion portion 85*a*. The toner supply roller insertion portion 85*a* is diagonally to the front below the developing roller bearing 84*a*. More specifically, the shaft receiving member 87*a* has a recessed portion, which is inwardly recessed (in an inward direction in the axial direction of the developing roller 34) and the supply roller insertion portion 85*a* is provided in the recessed portion so as to be diagonal to the front below the developing roller bearing 84*a*.

The roller shaft 33*a* of the toner supply roller 33 is rotatably supported by the toner supply roller insertion portion 85*a* and the opposite toner supply roller insertion portion. That is, one end portion of the roller shaft 33*a* of the toner supply roller 33 is rotatably supported by the toner supply roller insertion portion 85*a* so as to protrude to the outside of the housing 81. The other end portion of the roller shaft 33*a* is rotatably supported by the opposite toner supply roller insertion portion so as to protrude to the outside of the housing 81.

In this embodiment, the shaft receiving member 87*a* integrally includes a toner receiving portion 88*a* in order to receive toner leaking from the vicinity of an end of the developing roller 34. As shown in FIG. 4, the toner receiving portion 88*a* has a substantially rectangular shape and inwardly extends from the rear lower end of the shaft receiving member 87*a* to a position where the toner receiving portion 88*a* overlaps one end of the roller portion 34*b* of the developing roller 34 in the diameter direction.

As shown in FIG. 3, the drum frame 27 of the photosensitive body cartridge 95 has an opening 27*a* below the shaft receiving member 87*a* of the developing cartridge 29. Designated by a reference numeral 90 is a power supply terminal, which is provided on the body casing 2 side and whose base end is connected to an electric circuit 92. The power supply terminal 90 is a rod-like metal member upwardly extending toward a lower end of the shaft receiving member 87*a* through the opening 27*a*. The power supply terminal 90 is urged against the lower surface of the shaft receiving member 87*a* by a coil spring 91 as an urging member.

The power supply terminal 90 is designed such that its tip contacts the front end of the lower surface of the shaft receiving member 87*a*. More particularly, a straight line L (indicated by a dot and dashed line shown in FIG. 3), which extends in a direction in which the front end of the lower surface of the shaft receiving member 87*a* faces the power supply terminal 90 and passes through a contact position 93 of the front end of the lower surface of the shaft receiving member 87*a* and the power supply terminal 90, passes through a position deviated from the developing roller bearing 84*a* and the toner supply roller insertion portion 85*a*. The front end of the lower surface of the shaft receiving member 87*a* (the vicinity of the contact position 93) functions as a developer-side electrode portion. In this embodiment, the shaft receiving member 87*a* has a thin body, so that the shaft receiving member 87*a* is provided with a rib 87*b* that protrudes outward in the axial direction of the developing roller 34 and extends from its lower surface to front surface, as shown in FIG. 4. The power supply terminal 90 contacts the front end of the lower surface of the rib 87*b*, so that the electrical connection therebetween is ensured.

According to the structure described above, in the state where the process unit 22 is attached to the body casing 2, the lower surface of the shaft receiving member 87*a* of the developing cartridge 29 and the power supply terminal 90 of the body casing 2 are contacted with each other via the opening 27*a* of the photosensitive body cartridge 95. Thus, the power supply terminal 90 is electrically connected with the roller shaft 34*a* of the developing roller 34 via the shaft receiving member 87*a*, so that a bias voltage is applied to the developing roller 34 from the electric circuit 92.

According to the first exemplary embodiment, when the process unit 22 (the developing cartridge 29) is attached to the body casing 2, the front end of the lower surface of the shaft receiving member 87*a* as the developer-side electrode portion is electrically connected with the power supply terminal 90, which is opposite thereto from below, at the contact position 93, so that a bias voltage is applied to the developing roller 34. Therefore, as compared with the conventional structure, the developing roller 34 is not likely to experience a force exerting in the axial direction from the power supply terminal 90, so that a developing failure caused by the inclination of the developing roller 34 can be prevented.

The shaft receiving member 87*a* having the developing roller bearing 84*a* of the developing roller 34 is made of a conductive material, and the power supply terminal 90 contacts the developer-side electrode portion formed at the lower surface of the shaft receiving member 87*a*. That is, the developer-side electrode portion and the developing roller bearing 84*a* of the developing roller 34 are integrally provided to the single shaft receiving member 87*a*. Accordingly, a parts count can be reduced and an assembling process can be simplified.

The shaft receiving member 87*a* includes the toner supply roller insertion portion 85*a* so as to also serve as a bearing for the toner supply roller 33. Therefore, a parts count can be reduced as compared with a case where those bearings are separately provided for the developing roller 34 and the toner supply roller 33.

The straight line L, which extends in the direction in which the front end of the lower surface of the shaft receiving member 87*a* faces the power supply terminal 90 or in the urging direction of the coil spring 91 and which passes through the contact position 93 of the front end of the lower surface of the shaft receiving member 87*a* and the power supply terminal 90, passes through the position deviated from the developing roller bearing 84*a* and the toner supply roller insertion portion 85*a*. With this structure, the pressing force from the power supply terminal 90 side can be prevented from directly being exerted on the developing roller 34 and the toner supply roller 33, so that effects of the pressing force on the developing roller 34 and the toner supply roller 33 can be surely prevented.

The shaft receiving member 87*a* integrally provided with the toner receiving portion 88*a* to receive toner in case of occurrence of the toner leakage from the vicinity of the end portion of the developing roller 34, so that a parts count can be reduced as compared with a case where a toner receiving portion and a developing roller are separately provided.

The power supply terminal 90 has a projected tip opposing to the lower surface of the shaft receiving member 87*a* and elastically contacts the lower surface of the shaft receiving member 87*a* in the direction in which the power supply terminal 90 faces the lower surface of the shaft receiving member 87*a* by the urging force from the coil spring 91. Accordingly, the power supply terminal 90 can be moved up and down with respect to the developer-side electrode portion while saving space as compared with a case where the power supply electrode is made of an elastic electrode plate.

Figure 5:
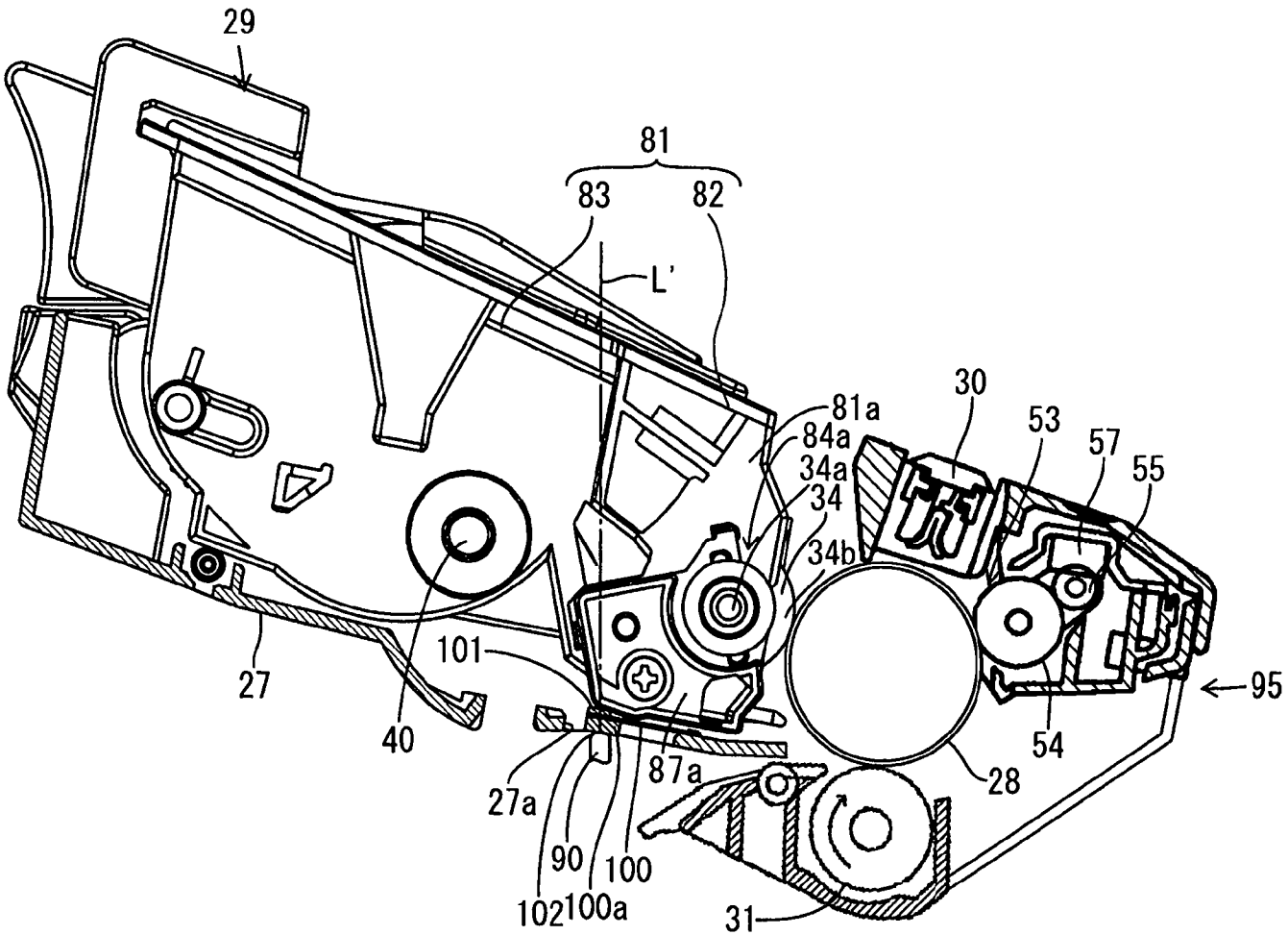
FIG. 5 is a side view of another developing cartridge.

Referring to FIG. 5, a second exemplary embodiment of the disclosure will be described below. The difference between the first exemplary embodiment and the second exemplary embodiment is that the photosensitive body cartridge 95 is provided with a conductive member 100 at the opening 27*a* in the second exemplary embodiment. The other portions of the second exemplary embodiment are the same as those of the first exemplary embodiment. Thus, the same parts are designated with the similar numerals and explanations for those parts will be omitted.

As shown in FIG. 5, in the second embodiment, the conductive member 100 is provided to the opening 27*a* of the photosensitive cartridge 95. More specifically, the conductive member 100 is fixed to a periphery of the opening 27*a* at its base end. The conductive member 100 is integrally provided with a contact portion 100*a* at its tip (a free end). With this structure, the contact portion 100*a* can swing up and down about the base end. In the state where the process unit 22 is attached to the body casing 2, the lower surface of the shaft receiving member 87*a* contacts an upper surface of the contact portion 100 and a lower surface of the contact portion 100*a* is pressed against the power supply terminal 90. In this embodiment, a straight line L', which passes through a contact position 101 of the lower surface of the shaft receiving member 87*a* and the conductive member 100 and a contact position 102 of the conductive member 100 and the power supply terminal 90, passes through a position deviated from the developing roller bearing 84*a* and the toner supply roller insertion portion 85*a*.

This structure also provides the same effects as those obtained by the structure of the first exemplary embodiment.

While the disclosure has been described in detail with reference to the specific embodiments thereof, it would be apparent to those skilled in the art that various changes, arrangements and modifications may be applied therein without departing from the spirit and scope of the disclosure.

In the above-described exemplary embodiments, the shaft receiving member 87*a* integrally includes the developing roller bearing 84*a*, the toner supply roller insertion portion 85*a* and the developer-side electrode portion. Instead of this structure, a developer-side electrode member that is electrically connected with the lower surface of the power supply electrode may be provided to apply a bias voltage to the developing roller 34. The developing roller bearing 84*a* and the toner supply roller insertion portion 85*a* may be provided separately from the developer-side electrode member. However, the structures described in the above exemplary embodiments achieve the reduction of a parts count and the simplification of the assembling operation.

In the above-described exemplary embodiments, the straight line L, which extends in the direction in which the lower surface of the shaft receiving member 87*a* faces the power supply terminal 90 and passes through the contact position 93 of the lower surface of the shaft receiving member 87*a* and the power supply terminal 90, and the straight line L', which passes through the contact position 101 of the lower surface of the shaft receiving member 87*a* and the conductive member 100 and the contact position 102 of the conductive member 100 and the power supply terminal 90, both pass through the position in front of the developing roller bearing 84*a* and the toner supply roller insertion portion 85*a* in FIGS. 3 and 5. That is, the pressing force from the power supply terminal 90 is exerted in the direction along the rotating directions of the developing roller 34 and the toner supply roller 33. Instead of this, the pressing force from the power supply terminal 90 is exerted in a direction opposite to the rotating directions of the developing roller 34 and the toner supply roller 33. That is, the straight line L, L' may pass through a position behind the developing roller bearing 84*a* and the toner supply roller insertion portion 85*a* in FIGS. 3 and 5.

The front end of the lower surface of the shaft receiving member 87*a* as the developer-side electrode portion may includes a protruding portion that protrudes downwardly toward the power supply terminal 90. With this structure, the protruding portion of the shaft receiving member 87*a* further strongly elastically contacts the power supply terminal 90 by the weight of the developing cartridge 29. Accordingly, the electrical connection between the shaft receiving member 87*a* and the power supply terminal 90 can be further surely ensured.

In the above-described exemplary embodiments, the process unit 22, the drum frame 27 and the developing cartridge 29 are designed so as to be attachable to and detachable from the body casing 2. However, they may be designed so as not to be attachable to and detachable from the body casing 2.

In order to make contact between the developer-side electrode portion and the power supply terminal 90, it may be designed such that at least one of or both of the developer-side electrode portion and the power supply terminal 90 may enter the opening 27*a*.

The disclosure described above can be applied to facsimile machines, and multifunctional machines having a printing function and a scanning function, as well as the laser beam printer 1.

According to the structure described above, when the developing cartridge having the developing roller and the developer-side electrode portion is attached to the body of the image forming apparatus, the developer-side electrode portion is electrically connected with the power supply electrode that is opposite thereto from below, so that a bias voltage is applied to the developing roller. Therefore, the developing roller is not likely to experience the force exerting in the axial direction, so that the developing failure caused by the inclination of the developing roller can be prevented as compared with the conventional structure.

The developer-side electrode portion is integrally provided to the shaft receiving member of the developing roller, and the power supply electrode of the image forming apparatus body is contacted with the developer-side electrode portion. Therefore, the developing roller is not likely to experience the force exerting in the axial direction, so that the developing failure caused by the inclination of the developing roller can be prevented as compared with the conventional structure.

In addition, the shaft receiving portion and the developer-side electrode portion can be achieved by a single part, so that the reduction of the parts count and the simplification of the assembling operation can be accomplished.

The pressing force from the power supply electrode to the developer-side electrode portion exerts in the direction deviated from the developing roller shaft receiving portion. Accordingly, the effects of the pressing force to the developing roller can be surely prevented.

The receiving portion is integrally provided to the shaft receiving member as the developing roller shaft receiving portion in order to receive developing agent leaking from the vicinity of the end of the developing roller. Therefore, the parts count can be reduced as compared with the structure in which the receiving portion and the developing roller shaft receiving member are separately provided.

The protruding portion of the developer-side electrode portion is elastically strongly contacted with the power supply electrode by the weight of the developing cartridge, so that the electrical connection between the developer-side electrode portion and the power supply electrode can be further surely ensured.

The shaft receiving member as the bearing of the developing roller also serves as the bearing of the supply roller, so that the parts count can be reduced as compared with the structure in which shaft receiving portions for the developing roller and the supply roller are separately provided.

When the process cartridge includes the developing cartridge and the image holding body cartridge that is attached to the developing cartridge so as to at least partially cover the lower side of the developing cartridge provided with the developer-side electrode portion, the portion of the cartridge frame of the image holding body cartridge positioned between the developer-side electrode portion and the power supply electrode is provided with the opening. The developer-side electrode portion and the power supply electrode are contacted with each other via the opening. Alternatively, the conductive member that brings the upper and lower surfaces of the portion of the cartridge frame of the image holding body positioned between the developer-side electrode portion and the power supply electrode into conduction may be provided. The developer-side electrode portion and the power supply electrode may be electrically connected with each other via the conductive member.

According to the above structure, the pressing force from the power supply electrode to the developer-side electrode portion exerts in the direction deviated from the image holding body, so that the effect of the pressing force the image holding body can be further surely prevented.

The power supply electrode is urged in the direction in which its projected tip faces the developer-side electrode portion so that the power supply electrode elastically contacts with the developer-side electrode portion. Accordingly, the power supply electrode can be moved up and down with respect to the developer-side electrode portion while saving space as compared with the structure in which the power supply electrode is made from an elastic electrode plate.

According to an exemplary aspect of the disclosure, when the developing cartridge having the developing roller and the developer-side electrode portion is attached to the body of the image forming apparatus, the developer-side electrode portion is electrically connected with the power supply electrode that is opposite thereto from below, so that a bias voltage is applied to the developing roller. Therefore, the developing roller is not likely to experience the force exerting in the axial direction, so that the developing failure caused by the inclination of the developing roller can be prevented as compared with the conventional structure.

According to an exemplary aspect of the disclosure, when the process cartridge includes the developing cartridge and the image holding body cartridge that is attached to the developing cartridge so as to at least partially cover the lower side of the developing cartridge provided with the developer-side electrode portion, the portion of the cartridge frame of the image holding body cartridge positioned between the developer-side electrode portion and the power supply electrode is provided with the opening. The developer-side electrode portion and the power supply electrode are contacted with each other via the opening.

According to an exemplary aspect of the disclosure, the conductive member that brings the upper and lower surfaces of the portion of the cartridge frame of the image holding body positioned between the developer-side electrode portion and the power supply electrode into conduction may be provided. The developer-side electrode portion and the power supply electrode may be electrically connected with each other via the conductive member.

While the disclosure has been described in detail with reference to the specific embodiments thereof, it would be apparent to those skilled in the art that various changes, arrangements and modifications may be applied therein without departing from the spirit and scope of the disclosure.

What is claimed is:

1. A developing cartridge, comprising:

a developing roller having a longitudinal axis, wherein a bias voltage is capable of being applied to the developing roller; and a developer-side electrode portion that is electrically connected with a shaft member of the developing roller, the developer-side electrode portion disposed on a surface of the developing cartridge that extends in a plane that is parallel to the longitudinal axis of the developing roller and including a contact point that contacts with a power feed electrode, wherein:

the contact point is positioned at a bottom of the developing cartridge in order to apply the bias voltage to the developing roller, and the developing cartridge is capable of being mounted to an image holding body cartridge with an image holding body that holds a developing agent image formed by a development of an electrostatic latent image.

2. The developing cartridge according to claim 1, wherein when the developing cartridge is mounted to the image holding body cartridge, the developer-side electrode portion is adjacent an opening in a frame of the image holding body cartridge.

3. The developing cartridge according to claim 1, wherein when the developing cartridge is mounted to an image forming apparatus together with the image holding body cartridge, the developer-side electrode portion is electrically connected with the power feed electrode that is opposite thereto from below, in order to apply the bias voltage to the developing roller.

4. The developing cartridge according to claim 3, wherein the power feed electrode includes a power supply electrode that is disposed at the image forming apparatus, and wherein the developer-side electrode portion is capable of being adjacent an opening in a frame of the image holding body cartridge while the developer-side electrode portion is capable of being in contact with the power supply electrode through the opening.

5. The developing cartridge according to claim 3, wherein the power feed electrode includes a conductive member that is disposed at a frame of the image holding body cartridge, and wherein the developer-side electrode portion is capable of being adjacent the conductive member of the frame while the developer-side electrode portion and a power supply electrode disposed at the image forming apparatus are electrically connected with each other via the conductive member, wherein the conductive member is interposed between the developer-side electrode portion and the power supply electrode.

6. The developing cartridge according to claim 1, further comprising a shaft receiving member that rotatably supports the shaft member of the developing roller, the shaft receiving member being made of a conductive member and being integrated with the developer-side electrode portion.

7. The developing cartridge according to claim 6, wherein the shaft receiving member includes a developing roller shaft receiving portion, and the developer-side electrode portion is provided at an end portion of the shaft receiving member at a position that is lower than the developing roller shaft receiving portion.

8. The developing cartridge according to claim 7, wherein a straight line, which extends in a direction in which the developer-side electrode portion is capable of facing the power feed electrode and passes through a position where the developer-side electrode portion and the power feed electrode are opposite to each other, passes through a position deviated from the developing roller shaft receiving portion of the shaft receiving member.

9. The developing cartridge according to claim 6, wherein the shaft receiving member integrally includes a receiving portion that receives developing agent leaking from a vicinity of an end of the developing roller.

10. The developing cartridge according to claim 3, wherein the developer-side electrode portion includes a protruding portion that downwardly protrudes and is capable of elastically contacting the power feed electrode urged in a direction opposite to the protruding portion.

11. The developing cartridge according to claim 1, further comprising:

a supply roller that supplies developing agent to the developing roller; and a shaft receiving member that rotatably supports the shaft member of the developing roller, the shaft receiving member integrally including a supply roller shaft receiving portion.

12. An image holding body cartridge, comprising:

an image holding body that holds a developing agent image formed by development of an electrostatic latent image; and a cartridge frame with an opening at a bottom of the cartridge frame, wherein:

when a developing cartridge with a developing roller and a developer-side electrode portion is mounted on the cartridge frame and the image holding body cartridge is mounted on an image forming apparatus with a power supply electrode, the power supply electrode portion contacts the developer-side electrode portion through the opening in order to apply a bias voltage from the power supply electrode to the developing roller.

13. The image holding body cartridge according to claim 12, wherein a straight line, which extends in a direction in which the developer-side electrode portion is capable of facing the power supply electrode and passes through a contact position of the developer-side electrode portion and the power supply electrode, passes through a position deviated from a position where the image holding body is provided.

14. An image holding body cartridge, comprising:

an image holding body that holds a developing agent image formed by development of an electrostatic latent image;

a cartridge frame, a portion of which is capable of being interposed between a power supply electrode provided to a body of an image forming apparatus and a developer-side electrode portion which electrically contacts the power supply electrode from above to apply a bias voltage from the power supply electrode to a developing roller; and a conductive member interposed between the developer-side electrode portion and the power supply electrode, wherein the developer-side electrode portion and the power supply electrode are capable of being electrically connected with each other via the conductive member.

15. The image holding body cartridge according to claim 14, wherein a straight line, which extends in a direction in which the developer-side electrode portion is capable of facing the power supply electrode and passes through a contact position of the developer-side electrode portion, the power supply electrode and the conductive member, passes through a position deviated from a position where the image holding body is provided.

16. A process cartridge, comprising:

the developing cartridge according to claim 1.

17. The process cartridge according to claim 16, wherein the developing cartridge is capable of being mounted to the image holding body cartridge such that a lower side, having the developer-side electrode portion, of the developing cartridge at least partially overlaps the image holding body cartridge.

18. The process cartridge according to claim 16, wherein when the developing cartridge is mounted to the image holding body cartridge, the developing cartridge and the image holding cartridge can be mounted together to an image forming apparatus.

19. An image forming apparatus, comprising:

the image holding body cartridge according to claim 12; and a power supply electrode that is capable of being electrically connected with the developer-side electrode portion of the developing cartridge.

20. An image forming apparatus, comprising:

the process cartridge of claim 16; and an image forming apparatus body that is capable of mounting the process cartridge, the image forming apparatus body having a power supply electrode that is capable of being electrically connected with a developer-side electrode portion of the developing cartridge.

21. The image forming apparatus according to claim 20, wherein the power supply electrode includes a projection that protrudes toward the developer-side electrode portion.

22. The image forming apparatus according to claim 21, comprising an urging device that urges the projection in a protruding direction to elastically contact the projection with the developer-side electrode portion.

* * * * *